US010325554B2

(12) United States Patent
Nathan et al.

(10) Patent No.: US 10,325,554 B2
(45) **Date of Patent: *Jun. 18, 2019**

(54) OLED LUMINANCE DEGRADATION COMPENSATION

(71) Applicant: Ignis Innovation Inc., Waterloo (CA)

(72) Inventors: Arokia Nathan, Cambridge (GB); Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 14 days.

This patent is subject to a terminal disclaimer.

(21) Appl. No.: 15/356,196

(22) Filed: Nov. 18, 2016

(65) Prior Publication Data

US 2017/0069266 A1 Mar. 9, 2017

Related U.S. Application Data

(63) Continuation of application No. 14/813,904, filed on Jul. 30, 2015, now Pat. No. 9,530,352, which is a (Continued)

(30) Foreign Application Priority Data

Aug. 15, 2006 (CA) ..... 2556961

(51) Int. Cl.
*H05B 33/08* (2006.01)
*G09G 3/3233* (2016.01)
(Continued)

(52) U.S. Cl.
CPC ..... *G09G 3/3233* (2013.01); *G09G 3/3241* (2013.01); *G09G 3/3283* (2013.01);
(Continued)

(58) Field of Classification Search
CPC ..... G09G 2320/029; G09G 2320/043; G09G 2320/045; G09G 3/32–3/3291
(Continued)

(56) References Cited

U.S. PATENT DOCUMENTS 3,506,851 A 4/1970 Polkinghorn
3,774,055 A 11/1973 Bapat
(Continued)

FOREIGN PATENT DOCUMENTS

CA 1 294 034 1/1992
CA 2 109 951 11/1992
(Continued)

OTHER PUBLICATIONS

Ahnood : "Effect of threshold voltage instability on field effect mobility in thin film transistors deduced from constant current measurements"; dated Aug. 2009.
(Continued)

*Primary Examiner* — Patrick F Marinelli
(74) *Attorney, Agent, or Firm* — Stratford Managers Corporation

(57) ABSTRACT

A system and method are disclosed for determining a pixel capacitance. The pixel capacitance is correlated to a pixel age to determine a current correction factor used for compensating the pixel drive current to account for luminance degradation of the pixel that results from the pixel aging.

21 Claims, 7 Drawing Sheets

Related U.S. Application Data continuation of application No. 14/052,146, filed on Oct. 11, 2013, now Pat. No. 9,125,278, which is a continuation of application No. 13/632,691, filed on Oct. 1, 2012, now Pat. No. 8,581,809, which is a continuation of application No. 13/179,963, filed on Jul. 11, 2011, now Pat. No. 8,279,143, which is a continuation of application No. 11/839,145, filed on Aug. 15, 2007, now Pat. No. 8,026,876.

(51) Int. Cl.
*G09G 3/3241* (2016.01)
*G09G 3/3283* (2016.01)

(52) U.S. Cl.
CPC . *H05B 33/0896* (2013.01); *G09G 2300/0465* (2013.01); *G09G 2300/0819* (2013.01); *G09G 2300/0842* (2013.01); *G09G 2320/029* (2013.01); *G09G 2320/0233* (2013.01); *G09G 2320/0295* (2013.01); *G09G 2320/041* (2013.01); *G09G 2320/043* (2013.01); *G09G 2320/045* (2013.01)

(58) Field of Classification Search
USPC ..... 345/76–83, 204–215, 690–699; 315/169.1–169.4
See application file for complete search history.

(56) References Cited

U.S. PATENT DOCUMENTS 4,090,096 A 5/1978 Nagami
4,160,934 A 7/1979 Kirsch
4,295,091 A * 10/1981 Ponkala ..... G01R 27/2605 324/120
4,354,162 A 10/1982 Wright
4,943,956 A 7/1990 Noro
4,996,523 A 2/1991 Bell
5,153,420 A 10/1992 Hack
5,198,803 A 3/1993 Shie
5,204,661 A 4/1993 Hack
5,266,515 A 11/1993 Robb
5,489,918 A 2/1996 Mosier
5,498,880 A 3/1996 Lee
5,557,342 A 9/1996 Eto
5,561,381 A * 10/1996 Jenkins ..... G01R 31/2621 324/678
5,572,444 A 11/1996 Lentz
5,589,847 A 12/1996 Lewis
5,619,033 A 4/1997 Weisfield
5,648,276 A 7/1997 Hara
5,670,973 A 9/1997 Bassetti
5,684,365 A 11/1997 Tang
5,691,783 A 11/1997 Numao
5,714,968 A 2/1998 Ikeda
5,723,950 A 3/1998 Wei
5,744,824 A 4/1998 Kousai
5,745,660 A 4/1998 Kolpatzik
5,748,160 A 5/1998 Shieh
5,815,303 A 9/1998 Berlin
5,870,071 A 2/1999 Kawahata
5,874,803 A 2/1999 Garbuzov
5,880,582 A 3/1999 Sawada
5,903,248 A 5/1999 Irwin
5,917,280 A 6/1999 Burrows
5,923,794 A 7/1999 McGrath
5,945,972 A 8/1999 Okumura
5,949,398 A 9/1999 Kim
5,952,789 A 9/1999 Stewart
5,952,991 A 9/1999 Akiyama
5,982,104 A * 11/1999 Sasaki ..... H05B 33/08 315/169.3
5,990,629 A 11/1999 Yamada
6,023,259 A 2/2000 Howard
6,069,365 A 5/2000 Chow
6,091,203 A 7/2000 Kawashima
6,097,360 A 8/2000 Holloman
6,144,222 A 11/2000 Ho
6,177,915 B1 1/2001 Beeteson
6,229,506 B1 5/2001 Dawson
6,229,508 B1 5/2001 Kane
6,246,180 B1 6/2001 Nishigaki
6,252,248 B1 6/2001 Sano
6,259,424 B1 7/2001 Kurogane
6,262,589 B1 * 7/2001 Tamukai ..... G09G 3/006 324/681
6,271,825 B1 8/2001 Greene
6,288,696 B1 9/2001 Holloman
6,304,039 B1 10/2001 Appelberg
6,307,322 B1 10/2001 Dawson
6,310,589 B1 * 10/2001 Nishigaki ..... G09G 3/3216 345/76
6,310,962 B1 10/2001 Chung
6,320,325 B1 11/2001 Cok
6,323,631 B1 11/2001 Juang
6,329,971 B2 12/2001 McKnight
6,356,029 B1 3/2002 Hunter
6,373,454 B1 4/2002 Knapp
6,377,237 B1 * 4/2002 Sojourner ..... G09G 3/3406 345/102
6,392,617 B1 5/2002 Gleason
6,404,139 B1 6/2002 Sasaki et al.
6,414,661 B1 7/2002 Shen
6,417,825 B1 7/2002 Stewart
6,433,488 B1 8/2002 Bu
6,437,106 B1 8/2002 Stoner
6,441,560 B1 * 8/2002 Hunter ..... G09G 3/3233 313/505
6,445,369 B1 9/2002 Yang
6,452,576 B1 * 9/2002 Van Velzen ..... G09G 3/3216 315/169.3
6,475,845 B2 11/2002 Kimura
6,501,098 B2 12/2002 Yamazaki
6,501,466 B1 12/2002 Yamagishi
6,518,962 B2 2/2003 Kimura
6,522,315 B2 2/2003 Ozawa
6,525,683 B1 2/2003 Gu
6,531,827 B2 3/2003 Kawashima
6,541,921 B1 * 4/2003 Luciano, Jr. ..... G09G 3/12 313/495
6,542,138 B1 4/2003 Shannon
6,545,651 B2 * 4/2003 Nishigaki ..... G09G 3/3216 345/76
6,555,420 B1 4/2003 Yamazaki
6,577,302 B2 6/2003 Hunter
6,580,408 B1 6/2003 Bae
6,580,657 B2 6/2003 Sanford
6,583,398 B2 6/2003 Harkin
6,583,775 B1 6/2003 Sekiya
6,594,606 B2 7/2003 Everitt
6,618,030 B2 9/2003 Kane
6,639,244 B1 10/2003 Yamazaki
6,668,645 B1 12/2003 Gilmour
6,677,713 B1 1/2004 Sung
6,680,580 B1 1/2004 Sung
6,687,266 B1 2/2004 Ma
6,690,000 B1 2/2004 Muramatsu
6,690,344 B1 2/2004 Takeuchi
6,693,388 B2 2/2004 Oomura
6,693,610 B2 2/2004 Shannon
6,697,057 B2 * 2/2004 Koyama ..... G09G 3/3233 315/169.3
6,720,942 B2 4/2004 Lee
6,724,151 B2 4/2004 Yoo
6,734,636 B2 5/2004 Sanford
6,738,034 B2 5/2004 Kaneko
6,738,035 B1 5/2004 Fan
6,753,655 B2 6/2004 Shih
6,753,834 B2 6/2004 Mikami
6,756,741 B2 6/2004 Li
6,756,952 B1 6/2004 Decaux
6,756,958 B2 6/2004 Furuhashi

(56) References Cited

U.S. PATENT DOCUMENTS 6,765,549 B1 * 7/2004 Yamazaki ..... G09G 3/3266 315/169.3
6,771,028 B1 8/2004 Winters
6,777,712 B2 8/2004 Sanford
6,777,888 B2 8/2004 Kondo
6,781,567 B2 8/2004 Kimura
6,806,497 B2 10/2004 Jo
6,806,638 B2 10/2004 Lih et al.
6,806,857 B2 10/2004 Sempel
6,809,706 B2 10/2004 Shimoda
6,815,975 B2 11/2004 Nara
6,828,950 B2 12/2004 Koyama
6,853,371 B2 2/2005 Miyajima
6,859,193 B1 2/2005 Yumoto
6,873,117 B2 3/2005 Ishizuka
6,876,346 B2 4/2005 Anzai
6,885,356 B2 4/2005 Hashimoto
6,900,485 B2 5/2005 Lee
6,903,734 B2 6/2005 Eu
6,909,243 B2 6/2005 Inukai
6,909,419 B2 6/2005 Zavracky
6,911,960 B1 6/2005 Yokoyama
6,911,964 B2 6/2005 Lee
6,914,448 B2 7/2005 Jinno
6,919,871 B2 7/2005 Kwon
6,924,602 B2 8/2005 Komiya
6,937,215 B2 8/2005 Lo
6,937,220 B2 8/2005 Kitaura
6,940,214 B1 9/2005 Komiya
6,943,500 B2 9/2005 LeChevalier
6,947,022 B2 9/2005 McCartney
6,954,194 B2 10/2005 Matsumoto
6,956,547 B2 10/2005 Bae
6,975,142 B2 12/2005 Azami
6,975,332 B2 12/2005 Arnold
6,995,510 B2 2/2006 Murakami
6,995,519 B2 2/2006 Arnold
7,023,408 B2 4/2006 Chen
7,027,015 B2 4/2006 Booth, Jr.
7,027,078 B2 4/2006 Reihl
7,034,793 B2 4/2006 Sekiya
7,038,392 B2 5/2006 Libsch
7,053,875 B2 * 5/2006 Chou ..... G09G 3/325 345/214
7,057,359 B2 6/2006 Hung
7,061,451 B2 6/2006 Kimura
7,064,733 B2 6/2006 Cok
7,071,932 B2 7/2006 Libsch
7,088,051 B1 8/2006 Cok
7,088,052 B2 8/2006 Kimura
7,102,378 B2 * 9/2006 Kuo ..... G09G 3/006 324/678
7,106,089 B2 * 9/2006 Nakano ..... G09G 3/006 324/762.09
7,106,285 B2 9/2006 Naugler
7,112,820 B2 9/2006 Chang
7,116,058 B2 10/2006 Lo
7,119,493 B2 * 10/2006 Fryer ..... G09G 3/12 315/169.1
7,122,835 B1 10/2006 Ikeda
7,127,380 B1 10/2006 Iverson
7,129,914 B2 10/2006 Knapp
7,161,566 B2 1/2007 Cok
7,164,417 B2 1/2007 Cok
7,193,589 B2 3/2007 Yoshida
7,224,332 B2 5/2007 Cok
7,227,519 B1 6/2007 Kawase
7,245,277 B2 7/2007 Ishizuka
7,246,912 B2 * 7/2007 Burger ..... H05B 33/08 313/506
7,248,236 B2 7/2007 Nathan
7,262,753 B2 8/2007 Tanghe
7,274,363 B2 9/2007 Ishizuka
7,310,092 B2 12/2007 Imamura
7,315,295 B2 1/2008 Kimura
7,321,348 B2 1/2008 Cok
7,339,560 B2 3/2008 Sun
7,355,574 B1 * 4/2008 Leon ..... G09G 3/3233 345/101
7,358,941 B2 4/2008 Ono
7,368,868 B2 5/2008 Sakamoto
7,397,485 B2 7/2008 Miller
7,411,571 B2 8/2008 Huh
7,414,600 B2 8/2008 Nathan
7,423,617 B2 9/2008 Giraldo
7,453,054 B2 11/2008 Lee
7,474,285 B2 1/2009 Kimura
7,502,000 B2 3/2009 Yuki
7,528,812 B2 5/2009 Tsuge
7,535,449 B2 5/2009 Miyazawa
7,554,512 B2 6/2009 Steer
7,569,849 B2 8/2009 Nathan
7,576,718 B2 8/2009 Miyazawa
7,580,012 B2 8/2009 Kim
7,589,707 B2 9/2009 Chou
7,605,792 B2 10/2009 Son
7,609,239 B2 10/2009 Chang
7,619,594 B2 11/2009 Hu
7,619,597 B2 11/2009 Nathan
7,633,470 B2 12/2009 Kane
7,656,370 B2 2/2010 Schneider
7,675,485 B2 3/2010 Steer
7,800,558 B2 9/2010 Routley
7,847,764 B2 12/2010 Cok
7,859,492 B2 12/2010 Kohno
7,868,859 B2 1/2011 Tomida
7,876,294 B2 1/2011 Sasaki
7,924,249 B2 4/2011 Nathan
7,932,883 B2 4/2011 Klompenhouwer
7,969,390 B2 6/2011 Yoshida
7,978,187 B2 7/2011 Nathan
7,994,712 B2 8/2011 Sung
8,026,876 B2 9/2011 Nathan
8,031,180 B2 * 10/2011 Miyamoto ..... G06F 3/0412 345/156
8,049,420 B2 11/2011 Tamura
8,077,123 B2 12/2011 Naugler, Jr.
8,115,707 B2 2/2012 Nathan
8,208,084 B2 6/2012 Lin
8,223,177 B2 7/2012 Nathan
8,232,939 B2 7/2012 Nathan
8,259,044 B2 9/2012 Nathan
8,264,431 B2 9/2012 Bulovic
8,279,143 B2 * 10/2012 Nathan ..... G09G 3/3233 315/169.3
8,289,247 B2 * 10/2012 Min ..... G09G 3/3233 345/204
8,294,696 B2 * 10/2012 Min ..... G09G 3/3233 345/204
8,314,783 B2 * 11/2012 Sambandan ..... G09G 3/3233 345/204
8,339,386 B2 12/2012 Leon
8,441,206 B2 5/2013 Myers
8,493,296 B2 7/2013 Ogawa
8,581,809 B2 * 11/2013 Nathan ..... G09G 3/3233 315/169.3
9,125,278 B2 * 9/2015 Nathan ..... G09G 3/3233
2001/0002703 A1 6/2001 Koyama
2001/0009283 A1 7/2001 Arao
2001/0024181 A1 9/2001 Kubota
2001/0024186 A1 9/2001 Kane
2001/0026257 A1 10/2001 Kimura
2001/0030323 A1 10/2001 Ikeda
2001/0035863 A1 11/2001 Kimura
2001/0038367 A1 11/2001 Inukai
2001/0040541 A1 11/2001 Yoneda
2001/0043173 A1 11/2001 Troutman
2001/0045929 A1 11/2001 Prache
2001/0052606 A1 12/2001 Sempel
2001/0052940 A1 12/2001 Hagihara
2002/0000576 A1 1/2002 Inukai
2002/0011796 A1 1/2002 Koyama
2002/0011799 A1 1/2002 Kimura

(56) References Cited

U.S. PATENT DOCUMENTS

2002/0012057 A1 1/2002 Kimura
2002/0014851 A1 2/2002 Tai
2002/0018034 A1 2/2002 Ohki
2002/0030190 A1 3/2002 Ohtani
2002/0047565 A1 4/2002 Nara
2002/0052086 A1 5/2002 Maeda
2002/0067134 A1 6/2002 Kawashima
2002/0084463 A1 7/2002 Sanford
2002/0101152 A1 8/2002 Kimura
2002/0101172 A1 8/2002 Bu
2002/0105279 A1* 8/2002 Kimura ..... G09G 3/14 315/169.3
2002/0117722 A1 8/2002 Osada
2002/0122308 A1 9/2002 Ikeda
2002/0158587 A1 10/2002 Komiya
2002/0158666 A1 10/2002 Azami
2002/0158823 A1 10/2002 Zavracky
2002/0167471 A1 11/2002 Everitt
2002/0167474 A1 11/2002 Everitt
2002/0169575 A1* 11/2002 Everitt ..... G09G 3/3216 702/107
2002/0180369 A1 12/2002 Koyama
2002/0180721 A1 12/2002 Kimura
2002/0181276 A1 12/2002 Yamazaki
2002/0183945 A1* 12/2002 Everitt ..... G09G 3/3216 702/64
2002/0186214 A1 12/2002 Siwinski
2002/0190924 A1 12/2002 Asano
2002/0190971 A1 12/2002 Nakamura
2002/0195967 A1 12/2002 Kim
2002/0195968 A1 12/2002 Sanford
2003/0020413 A1 1/2003 Oomura
2003/0030603 A1 2/2003 Shimoda
2003/0043088 A1 3/2003 Booth
2003/0057895 A1* 3/2003 Kimura ..... G09G 3/3233 315/370
2003/0058226 A1 3/2003 Bertram
2003/0062524 A1 4/2003 Kimura
2003/0063081 A1 4/2003 Kimura
2003/0071821 A1 4/2003 Sundahl
2003/0076048 A1 4/2003 Rutherford
2003/0090447 A1 5/2003 Kimura
2003/0090481 A1 5/2003 Kimura
2003/0107560 A1 6/2003 Yumoto
2003/0111966 A1 6/2003 Mikami
2003/0122745 A1 7/2003 Miyazawa
2003/0122749 A1* 7/2003 Booth, Jr. ..... G09G 3/3208 345/82
2003/0122813 A1 7/2003 Ishizuki
2003/0142088 A1* 7/2003 LeChevalier ..... G09G 3/3216 345/211
2003/0146897 A1* 8/2003 Hunter ..... G09G 3/342 345/102
2003/0151569 A1 8/2003 Lee
2003/0156101 A1* 8/2003 LeChevalier ..... G09G 3/3216 345/204
2003/0169241 A1 9/2003 LeChevalier
2003/0174152 A1 9/2003 Noguchi
2003/0179626 A1 9/2003 Sanford
2003/0185438 A1 10/2003 Osawa
2003/0197663 A1 10/2003 Lee
2003/0210256 A1 11/2003 Mori
2003/0230141 A1 12/2003 Gilmour
2003/0230980 A1 12/2003 Forrest
2003/0231148 A1 12/2003 Lin
2004/0032382 A1 2/2004 Cok
2004/0041750 A1 3/2004 Abe
2004/0066357 A1 4/2004 Kawasaki
2004/0070557 A1 4/2004 Asano
2004/0070565 A1 4/2004 Nayar
2004/0090186 A1 5/2004 Kanauchi
2004/0090400 A1 5/2004 Yoo
2004/0095297 A1 5/2004 Libsch
2004/0100427 A1 5/2004 Miyazawa
2004/0108518 A1 6/2004 Jo
2004/0135749 A1 7/2004 Kondakov
2004/0140982 A1 7/2004 Pate
2004/0145547 A1 7/2004 Oh
2004/0150592 A1 8/2004 Mizukoshi
2004/0150594 A1 8/2004 Koyama
2004/0150595 A1 8/2004 Kasai
2004/0155841 A1 8/2004 Kasai
2004/0174347 A1 9/2004 Sun
2004/0174349 A1 9/2004 Libsch
2004/0174354 A1 9/2004 Ono
2004/0178743 A1 9/2004 Miller
2004/0183759 A1 9/2004 Stevenson
2004/0196275 A1 10/2004 Hattori
2004/0207615 A1 10/2004 Yumoto
2004/0227697 A1 11/2004 Mori
2004/0233125 A1 11/2004 Tanghe
2004/0239596 A1 12/2004 Ono
2004/0246019 A1* 12/2004 Nakano ..... G09G 3/006 324/762.09
2004/0252089 A1 12/2004 Ono
2004/0257313 A1 12/2004 Kawashima
2004/0257353 A1 12/2004 Imamura
2004/0257355 A1 12/2004 Naugler
2004/0263437 A1 12/2004 Hattori
2004/0263444 A1* 12/2004 Kimura ..... G09G 3/14 345/82
2004/0263445 A1* 12/2004 Inukai ..... G09G 3/3266 345/82
2004/0263541 A1 12/2004 Takeuchi
2005/0007355 A1 1/2005 Miura
2005/0007357 A1 1/2005 Yamashita
2005/0007392 A1 1/2005 Kasai
2005/0017650 A1 1/2005 Fryer
2005/0024081 A1* 2/2005 Kuo ..... G09G 3/006 324/756.07
2005/0024393 A1 2/2005 Kondo
2005/0030267 A1* 2/2005 Tanghe ..... G09G 3/3216 345/82
2005/0057484 A1 3/2005 Diefenbaugh
2005/0057580 A1 3/2005 Yamano
2005/0067970 A1 3/2005 Libsch
2005/0067971 A1 3/2005 Kane
2005/0068270 A1 3/2005 Awakura
2005/0068275 A1 3/2005 Kane
2005/0073264 A1 4/2005 Matsumoto
2005/0083323 A1 4/2005 Suzuki
2005/0088103 A1 4/2005 Kageyama
2005/0105031 A1 5/2005 Shih
2005/0110420 A1 5/2005 Arnold
2005/0110807 A1 5/2005 Chang
2005/0122294 A1 6/2005 Ben-David
2005/0140598 A1 6/2005 Kim
2005/0140610 A1 6/2005 Smith
2005/0145891 A1 7/2005 Abe
2005/0156831 A1 7/2005 Yamazaki
2005/0162079 A1 7/2005 Sakamoto
2005/0168416 A1 8/2005 Hashimoto
2005/0179626 A1 8/2005 Yuki
2005/0179628 A1 8/2005 Kimura
2005/0185200 A1 8/2005 Tobol
2005/0200575 A1 9/2005 Kim
2005/0206590 A1 9/2005 Sasaki
2005/0212787 A1 9/2005 Noguchi
2005/0219184 A1 10/2005 Zehner
2005/0225683 A1 10/2005 Nozawa
2005/0248515 A1 11/2005 Naugler
2005/0269959 A1 12/2005 Uchino
2005/0269960 A1 12/2005 Ono
2005/0280615 A1 12/2005 Cok
2005/0280766 A1 12/2005 Johnson
2005/0285822 A1* 12/2005 Reddy ..... G06F 3/03542 345/76
2005/0285825 A1 12/2005 Eom
2006/0001613 A1 1/2006 Routley
2006/0007072 A1 1/2006 Choi
2006/0007206 A1 1/2006 Reddy et al.
2006/0007249 A1 1/2006 Reddy
2006/0012310 A1 1/2006 Chen

(56) References Cited

U.S. PATENT DOCUMENTS

2006/0012311 A1 1/2006 Ogawa
2006/0015272 A1 1/2006 Giraldo et al.
2006/0022305 A1 2/2006 Yamashita
2006/0022907 A1* 2/2006 Uchino ..... G09G 3/3233 345/76
2006/0027807 A1 2/2006 Nathan
2006/0030084 A1 2/2006 Young
2006/0038501 A1* 2/2006 Koyama ..... G09G 3/3216 315/169.3
2006/0038758 A1 2/2006 Routley
2006/0038762 A1 2/2006 Chou
2006/0044227 A1 3/2006 Hadcock
2006/0061248 A1 3/2006 Cok
2006/0066533 A1 3/2006 Sato
2006/0077134 A1 4/2006 Hector et al.
2006/0077135 A1* 4/2006 Cok ..... G09G 3/3216 345/76
2006/0077136 A1* 4/2006 Cok ..... G09G 3/3216 345/76
2006/0077142 A1 4/2006 Kwon
2006/0082523 A1 4/2006 Guo
2006/0092185 A1 5/2006 Jo
2006/0097628 A1 5/2006 Suh
2006/0097631 A1 5/2006 Lee
2006/0103324 A1* 5/2006 Kim ..... G09G 3/3233 315/169.3
2006/0103611 A1 5/2006 Choi
2006/0125740 A1 6/2006 Shirasaki et al.
2006/0149493 A1* 7/2006 Sambandan ..... G09G 3/3233 702/118
2006/0170623 A1* 8/2006 Naugler, Jr. ..... G09G 3/2011 345/76
2006/0176250 A1 8/2006 Nathan
2006/0208961 A1 9/2006 Nathan
2006/0208971 A1 9/2006 Deane
2006/0214888 A1 9/2006 Schneider
2006/0231740 A1 10/2006 Kasai
2006/0232522 A1 10/2006 Roy
2006/0244697 A1 11/2006 Lee
2006/0256048 A1 11/2006 Fish et al.
2006/0261841 A1 11/2006 Fish
2006/0273997 A1 12/2006 Nathan
2006/0279481 A1 12/2006 Haruna
2006/0284801 A1 12/2006 Yoon
2006/0284802 A1 12/2006 Kohno
2006/0284895 A1 12/2006 Marcu
2006/0290614 A1 12/2006 Nathan
2006/0290618 A1 12/2006 Goto
2007/0001937 A1 1/2007 Park
2007/0001939 A1 1/2007 Hashimoto
2007/0008251 A1 1/2007 Kohno
2007/0008268 A1 1/2007 Park
2007/0008297 A1 1/2007 Bassetti
2007/0057873 A1 3/2007 Uchino
2007/0057874 A1 3/2007 Le Roy
2007/0069998 A1 3/2007 Naugler
2007/0075727 A1 4/2007 Nakano
2007/0076226 A1 4/2007 Klompenhouwer
2007/0080905 A1 4/2007 Takahara
2007/0080906 A1 4/2007 Tanabe
2007/0080908 A1 4/2007 Nathan
2007/0097038 A1 5/2007 Yamazaki
2007/0097041 A1 5/2007 Park
2007/0103411 A1 5/2007 Cok et al.
2007/0103419 A1 5/2007 Uchino
2007/0115221 A1 5/2007 Buchhauser
2007/0126672 A1 6/2007 Tada et al.
2007/0164664 A1 7/2007 Ludwicki
2007/0164937 A1 7/2007 Jung et al.
2007/0164938 A1 7/2007 Shin
2007/0182671 A1 8/2007 Nathan
2007/0194379 A1* 8/2007 Hosono ..... C23C 14/0021 257/347
2007/0236134 A1 10/2007 Ho
2007/0236440 A1 10/2007 Wacyk
2007/0236517 A1 10/2007 Kimpe
2007/0241999 A1 10/2007 Lin
2007/0273294 A1 11/2007 Nagayama
2007/0285359 A1 12/2007 Ono
2007/0290957 A1 12/2007 Cok
2007/0290958 A1 12/2007 Cok
2007/0296672 A1 12/2007 Kim
2008/0001525 A1 1/2008 Chao
2008/0001544 A1 1/2008 Murakami
2008/0030518 A1 2/2008 Higgins
2008/0036706 A1 2/2008 Kitazawa
2008/0036708 A1 2/2008 Shirasaki
2008/0042942 A1 2/2008 Takahashi
2008/0042948 A1 2/2008 Yamashita
2008/0048951 A1 2/2008 Naugler, Jr.
2008/0055209 A1 3/2008 Cok
2008/0055211 A1 3/2008 Ogawa
2008/0074413 A1 3/2008 Ogura
2008/0088549 A1 4/2008 Nathan
2008/0088648 A1* 4/2008 Nathan ..... G09G 3/3233 345/690
2008/0111766 A1 5/2008 Uchino
2008/0116787 A1 5/2008 Hsu
2008/0117144 A1 5/2008 Nakano et al.
2008/0136770 A1 6/2008 Peker et al.
2008/0150845 A1 6/2008 Ishii
2008/0150847 A1 6/2008 Kim
2008/0158115 A1 7/2008 Cordes
2008/0158648 A1 7/2008 Cummings
2008/0191976 A1 8/2008 Nathan
2008/0198103 A1 8/2008 Toyomura
2008/0211749 A1 9/2008 Weitbruch
2008/0218451 A1 9/2008 Miyamoto
2008/0231558 A1 9/2008 Naugler
2008/0231562 A1 9/2008 Kwon
2008/0231625 A1 9/2008 Minami
2008/0246713 A1 10/2008 Lee
2008/0252223 A1 10/2008 Toyoda
2008/0252571 A1 10/2008 Hente
2008/0259020 A1 10/2008 Fisekovic
2008/0290805 A1 11/2008 Yamada
2008/0297055 A1 12/2008 Miyake
2009/0033598 A1 2/2009 Suh
2009/0058772 A1 3/2009 Lee
2009/0109142 A1 4/2009 Takahara
2009/0121994 A1 5/2009 Miyata
2009/0146926 A1 6/2009 Sung
2009/0160743 A1 6/2009 Tomida
2009/0174628 A1 7/2009 Wang
2009/0184901 A1 7/2009 Kwon
2009/0195483 A1 8/2009 Naugler, Jr.
2009/0201281 A1 8/2009 Routley
2009/0206764 A1 8/2009 Schemmann
2009/0207160 A1 8/2009 Shirasaki et al.
2009/0213046 A1 8/2009 Nam
2009/0244046 A1 10/2009 Seto
2009/0262047 A1 10/2009 Yamashita
2010/0004891 A1 1/2010 Ahlers
2010/0026725 A1 2/2010 Smith
2010/0039422 A1 2/2010 Seto
2010/0039458 A1 2/2010 Nathan
2010/0045646 A1 2/2010 Kishi
2010/0045650 A1 2/2010 Fish et al.
2010/0060911 A1 3/2010 Marcu
2010/0073335 A1* 3/2010 Min ..... G09G 3/3233 345/204
2010/0073357 A1* 3/2010 Min ..... G09G 3/3233 345/214
2010/0079419 A1 4/2010 Shibusawa
2010/0085282 A1 4/2010 Yu
2010/0103160 A1 4/2010 Jeon
2010/0134469 A1 6/2010 Ogura et al.
2010/0134475 A1 6/2010 Ogura et al.
2010/0165002 A1 7/2010 Ahn
2010/0194670 A1 8/2010 Cok
2010/0207960 A1 8/2010 Kimpe
2010/0225630 A1 9/2010 Levey
2010/0251295 A1 9/2010 Amento

(56) References Cited

U.S. PATENT DOCUMENTS

| | | | | |
|---|---|---|---|---|
| 2010/0277400 | A1 | 11/2010 | Jeong | |
| 2010/0315319 | A1 | 12/2010 | Cok | |
| 2011/0050870 | A1 | 3/2011 | Hanari | |
| 2011/0063197 | A1 | 3/2011 | Chung | |
| 2011/0069051 | A1 | 3/2011 | Nakamura | |
| 2011/0069089 | A1 | 3/2011 | Kopf | |
| 2011/0069096 | A1 | 3/2011 | Li | |
| 2011/0074750 | A1 | 3/2011 | Leon | |
| 2011/0074762 | A1 | 3/2011 | Shirasaki et al. | |
| 2011/0149166 | A1 | 6/2011 | Botzas | |
| 2011/0169798 | A1 | 7/2011 | Lee | |
| 2011/0175895 | A1 | 7/2011 | Hayakawa | |
| 2011/0181630 | A1 | 7/2011 | Smith | |
| 2011/0199395 | A1 | 8/2011 | Nathan | |
| 2011/0227964 | A1 | 9/2011 | Chaji | |
| 2011/0242074 | A1 | 10/2011 | Bert et al. | |
| 2011/0273399 | A1 | 11/2011 | Lee | |
| 2011/0279488 | A1* | 11/2011 | Nathan | G09G 3/3233 345/690 |
| 2011/0292006 | A1 | 12/2011 | Kim | |
| 2011/0293480 | A1 | 12/2011 | Mueller | |
| 2012/0056558 | A1 | 3/2012 | Toshiya | |
| 2012/0062565 | A1 | 3/2012 | Fuchs | |
| 2012/0262184 | A1 | 10/2012 | Shen | |
| 2012/0299970 | A1 | 11/2012 | Bae | |
| 2012/0299978 | A1 | 11/2012 | Chaji | |
| 2013/0027381 | A1 | 1/2013 | Nathan | |
| 2013/0057595 | A1* | 3/2013 | Nathan | G09G 3/3233 345/690 |
| 2013/0112960 | A1 | 5/2013 | Chaji | |
| 2013/0135272 | A1 | 5/2013 | Park | |
| 2013/0162617 | A1 | 6/2013 | Yoon | |
| 2013/0201223 | A1 | 8/2013 | Li et al. | |
| 2013/0309821 | A1 | 11/2013 | Yoo | |
| 2013/0321671 | A1 | 12/2013 | Cote | |
| 2014/0015824 | A1 | 1/2014 | Chaji et al. | |
| 2014/0022289 | A1 | 1/2014 | Lee | |
| 2014/0043316 | A1 | 2/2014 | Chaji et al. | |
| 2014/0055500 | A1 | 2/2014 | Lai | |
| 2014/0111567 | A1 | 4/2014 | Nathan et al. | |
| 2016/0275860 | A1 | 9/2016 | Wu | |

FOREIGN PATENT DOCUMENTS

| | | | |
|---|---|---|---|
| CA | 2 249 592 | | 7/1998 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 438 577 | | 8/2002 |
| CA | 2 463 653 | | 1/2004 |
| CA | 2 498 136 | | 3/2004 |
| CA | 2 522 396 | | 11/2004 |
| CA | 2 443 206 | | 3/2005 |
| CA | 2 472 671 | | 12/2005 |
| CA | 2 567 076 | | 1/2006 |
| CA | 2526436 | | 2/2006 |
| CA | 2 526 782 | | 4/2006 |
| CA | 2 541 531 | | 7/2006 |
| CA | 2 550 102 | | 4/2008 |
| CA | 2 773 699 | | 10/2013 |
| CN | 1381032 | | 11/2002 |
| CN | 1448908 | | 10/2003 |
| CN | 1682267 | A | 10/2005 |
| CN | 1760945 | | 4/2006 |
| CN | 1886774 | | 12/2006 |
| CN | 101449311 | | 6/2009 |
| CN | 102656621 | | 9/2012 |
| EP | 0 158 366 | | 10/1985 |
| EP | 1 028 471 | | 8/2000 |
| EP | 1 111 577 | | 6/2001 |
| EP | 1 130 565 | A1 | 9/2001 |
| EP | 1 194 013 | | 4/2002 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 145 0341 | A | 8/2004 |
| EP | 1 465 143 | A | 10/2004 |
| EP | 1 469 448 | A | 10/2004 |
| EP | 1 521 203 | A2 | 4/2005 |
| EP | 1 594 347 | | 11/2005 |
| EP | 1 784 055 | A2 | 5/2007 |
| EP | 1854338 | A1 | 11/2007 |
| EP | 1 879 169 | A1 | 1/2008 |
| EP | 1 879 172 | | 1/2008 |
| EP | 2395499 | A1 | 12/2011 |
| GB | 2 389 951 | | 12/2003 |
| JP | 1272298 | | 10/1989 |
| JP | 4-042619 | | 2/1992 |
| JP | 6-314977 | | 11/1994 |
| JP | 8-340243 | | 12/1996 |
| JP | 09-090405 | | 4/1997 |
| JP | 10-254410 | | 9/1998 |
| JP | 11-202295 | | 7/1999 |
| JP | 11-219146 | | 8/1999 |
| JP | 11 231805 | | 8/1999 |
| JP | 11-282419 | | 10/1999 |
| JP | 2000-056847 | | 2/2000 |
| JP | 2000-81607 | | 3/2000 |
| JP | 2001-134217 | | 5/2001 |
| JP | 2001-195014 | | 7/2001 |
| JP | 2002-055654 | | 2/2002 |
| JP | 2002-91376 | | 3/2002 |
| JP | 2002-514320 | | 5/2002 |
| JP | 2002-229513 | | 8/2002 |
| JP | 2002-278513 | | 9/2002 |
| JP | 2002-333862 | | 11/2002 |
| JP | 2003-076331 | | 3/2003 |
| JP | 2003-124519 | | 4/2003 |
| JP | 2003-177709 | | 6/2003 |
| JP | 2003-271095 | | 9/2003 |
| JP | 2003-308046 | | 10/2003 |
| JP | 2003-317944 | | 11/2003 |
| JP | 2004-004675 | | 1/2004 |
| JP | 2004-045648 | | 2/2004 |
| JP | 2004-145197 | | 5/2004 |
| JP | 2004-287345 | | 10/2004 |
| JP | 2005-057217 | | 3/2005 |
| JP | 2007-065015 | | 3/2007 |
| JP | 2007-155754 | | 6/2007 |
| JP | 2008-102335 | | 5/2008 |
| JP | 4-158570 | | 10/2008 |
| JP | 2003-195813 | | 7/2013 |
| KR | 2004-0100887 | | 12/2004 |
| TW | 342486 | | 10/1998 |
| TW | 473622 | | 1/2002 |
| TW | 485337 | | 5/2002 |
| TW | 502233 | | 9/2002 |
| TW | 538650 | | 6/2003 |
| TW | 1221268 | | 9/2004 |
| TW | 1223092 | | 11/2004 |
| TW | 200727247 | | 7/2007 |
| WO | WO 1998/48403 | | 10/1998 |
| WO | WO 1999/48079 | | 9/1999 |
| WO | WO 2001/06484 | | 1/2001 |
| WO | WO 2001/27910 | A1 | 4/2001 |
| WO | WO 2001/63587 | A2 | 8/2001 |
| WO | WO 2002/067327 | A | 8/2002 |
| WO | WO 2003/001496 | A1 | 1/2003 |
| WO | WO 2003/034389 | A | 4/2003 |
| WO | WO 2003/058594 | A1 | 7/2003 |
| WO | WO 2003/063124 | | 7/2003 |
| WO | WO 2003/077231 | | 9/2003 |
| WO | WO 2004/003877 | | 1/2004 |
| WO | WO 2004/025615 | A | 3/2004 |
| WO | WO 2004/034364 | | 4/2004 |
| WO | WO 2004/047058 | | 6/2004 |
| WO | WO 2004/104975 | A1 | 12/2004 |
| WO | WO 2005/022498 | | 3/2005 |
| WO | WO 2005/022500 | A | 3/2005 |

(56) References Cited

FOREIGN PATENT DOCUMENTS

| | | | |
|---|---|---|---|
| WO | WO 2005/029455 | | 3/2005 |
| WO | WO 2005/029456 | | 3/2005 |
| WO | WO/2005/034072 | A1 | 4/2005 |
| WO | WO 2005/055185 | | 6/2005 |
| WO | WO 2006/000101 | A1 | 1/2006 |
| WO | WO 2006/053424 | | 5/2006 |
| WO | WO 2006/063448 | A | 6/2006 |
| WO | WO 2006/084360 | | 8/2006 |
| WO | WO 2007/003877 | A | 1/2007 |
| WO | WO 2007/079572 | | 7/2007 |
| WO | WO 2007/120849 | A2 | 10/2007 |
| WO | WO 2009/048618 | | 4/2009 |
| WO | WO 2009/055920 | | 5/2009 |
| WO | WO 2010/023270 | | 3/2010 |
| WO | WO 2010/146707 | A1 | 12/2010 |
| WO | WO 2011/041224 | A1 | 4/2011 |
| WO | WO 2011/064761 | A1 | 6/2011 |
| WO | WO 2011/067729 | | 6/2011 |
| WO | WO 2012/160424 | A1 | 11/2012 |
| WO | WO 2012/160471 | | 11/2012 |
| WO | WO 2012/164474 | A2 | 12/2012 |
| WO | WO 2012/164475 | A2 | 12/2012 |

OTHER PUBLICATIONS

Alexander : "Pixel circuits and drive schemes for glass and elastic AMOLED displays"; dated Jul. 2005 (9 pages).
Alexander : "Unique Electrical Measurement Technology for Compensation, Inspection, and Process Diagnostics of AMOLED HDTV"; dated May 2010 (4 pages).
Ashtiani : "AMOLED Pixel Circuit With Electronic Compensation of Luminance Degradation"; dated Mar. 2007 (4 pages).
Chaji : "A Current-Mode Comparator for Digital Calibration of Amorphous Silicon AMOLED Displays"; dated Jul. 2008 (5 pages).
Chaji : "A fast settling current driver based on the CCII for AMOLED displays"; dated Dec. 2009 (6 pages).
Chaji : "A Low-Cost Stable Amorphous Silicon AMOLED Display with Full V~T- and V~O~L~E~D Shift Compensation"; dated May 2007 (4 pages).
Chaji : "A low-power driving scheme for a-Si:H active-matrix organic light-emitting diode displays"; dated Jun. 2005 (4 pages).
Chaji : "A low-power high-performance digital circuit for deep submicron technologies"; dated Jun. 2005 (4 pages).
Chaji : "A novel a-Si:H AMOLED pixel circuit based on short-term stress stability of a-Si:H TFTs"; dated Oct. 2005 (3 pages).
Chaji : "A Novel Driving Scheme and Pixel Circuit for AMOLED Displays"; dated Jun. 2006 (4 pages).
Chaji : "A Novel Driving Scheme for High Resolution Large-area a-Si:H AMOLED displays"; dated Aug. 2005 (3 pages).
Chaji : "A Stable Voltage-Programmed Pixel Circuit for a-Si:H AMOLED Displays"; dated Dec. 2006 (12 pages).
Chaji : "A Sub-μA fast-settling current-programmed pixel circuit for AMOLED displays"; dated Sep. 2007.
Chaji : "An Enhanced and Simplified Optical Feedback Pixel Circuit for AMOLED Displays"; dated Oct. 2006.
Chaji : "Compensation technique for DC and transient instability of thin film transistor circuits for large-area devices"; dated Aug. 2008.
Chaji : "Driving scheme for stable operation of 2-TFT a-Si AMOLED pixel"; dated Apr. 2005 (2 pages).
Chaji : "Dynamic-effect compensating technique for stable a-Si:H AMOLED displays"; dated Aug. 2005 (4 pages).
Chaji : "Electrical Compensation of OLED Luminance Degradation"; dated Dec. 2007 (3 pages).
Chaji : "eUTDSP: a design study of a new VLIW-based DSP architecture"; dated May 2003 (4 pages).
Chaji : "Fast and Offset-Leakage Insensitive Current-Mode Line Driver for Active Matrix Displays and Sensors"; dated Feb. 2009 (8 pages).
Chaji : "High Speed Low Power Adder Design With a New Logic Style: Pseudo Dynamic Logic (SDL)"; dated Oct. 2001 (4 pages).
Chaji : "High-precision, fast current source for large-area current-programmed a-Si flat panels"; dated Sep. 2006 (4 pages).
Chaji : "Low-Cost AMOLED Television with IGNIS Compensating Technology"; dated May 2008 (4 pages).
Chaji : "Low-Cost Stable a-Si:H AMOLED Display for Portable Applications"; dated Jun. 2006 (4 pages).
Chaji : "Low-Power Low-Cost Voltage-Programmed a-Si:H AMOLED Display"; dated Jun. 2008 (5 pages).
Chaji : "Merged phototransistor pixel with enhanced near infrared response and flicker noise reduction for biomolecular imaging"; dated Nov. 2008 (3 pages).
Chaji : "Parallel Addressing Scheme for Voltage-Programmed Active-Matrix OLED Displays"; dated May 2007 (6 pages).
Chaji : "Pseudo dynamic logic (SDL): a high-speed and low-power dynamic logic family"; dated 2002 (4 pages).
Chaji : "Stable a-Si:H circuits based on short-term stress stability of amorphous silicon thin film transistors"; dated May 2006 (4 pages).
Chaji : "Stable Pixel Circuit for Small-Area High-Resolution a-Si:H AMOLED Displays"; dated Oct. 2008 (6 pages).
Chaji : "Stable RGBW AMOLED display with OLED degradation compensation using electrical feedback"; dated Feb. 2010 (2 pages).
Chaji : "Thin-Film Transistor Integration for Biomedical Imaging and AMOLED Displays"; dated 2008 (177 pages).
European Search Report for Application No. EP 04 78 6661 dated Mar. 9, 2009.
European Search Report for Application No. EP 05 75 9141 dated Oct. 30, 2009 (2 pages).
European Search Report for Application No. EP 05 81 9617 dated Jan. 30, 2009.
European Search Report for Application No. EP 06 70 5133 dated Jul. 18, 2008.
European Search Report for Application No. EP 06 72 1798 dated Nov. 12, 2009 (2 pages).
European Search Report for Application No. EP 07 71 0608.6 dated Mar. 19, 2010 (7 pages).
European Search Report for Application No. EP 07 71 9579 dated May 20, 2009.
European Search Report for Application No. EP 07 81 5784 dated Jul. 20, 2010 (2 pages).
European Search Report for Application No. EP 10 16 6143, dated Sep. 3, 2010 (2 pages).
European Search Report for Application No. EP 10 83 4294.0-1903, dated Apr. 8, 2013, (9 pages).
European Supplementary Search Report for Application No. EP 04 78 6662 dated Jan. 19, 2007 (2 pages).
Extended European Search Report for Application No. 11 73 9485.8 dated Aug. 6, 2013 (14 pages).
Extended European Search Report for Application No. EP 09 73 3076.5, dated Apr. 27, (13 pages).
Extended European Search Report for Application No. EP 11 16 8677.0, dated Nov. 29, 2012, (13 page).
Extended European Search Report for Application No. EP 11 19 1641.7 dated Jul. 11, 2012 (14 pages).
Extended European Search Report for Application No. EP 10834297 dated Oct. 27, 2014 (6 pages).
Fossum, Eric R.. "Active Pixel Sensors: Are CCD's Dinosaurs?" SPIE: Symposium on Electronic Imaging. Feb. 1, 1993 (13 pages).
Goh , "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.
International Preliminary Report on Patentability for Application No. PCT/CA2005/001007 dated Oct. 16, 2006, 4 pages.
International Search Report for Application No. PCT/CA2004/001741 dated Feb. 21, 2005.
International Search Report for Application No. PCT/CA2004/001742, Canadian Patent Office, dated Feb. 21, 2005 (2 pages).
International Search Report for Application No. PCT/CA2005/001007 dated Oct. 18, 2005.
International Search Report for Application No. PCT/CA2005/001897, dated Mar. 21, 2006 (2 pages).
International Search Report for Application No. PCT/CA2007/000652 dated Jul. 25, 2007.

(56) References Cited

OTHER PUBLICATIONS

International Search Report for Application No. PCT/CA2009/000501, dated Jul. 30, 2009 (4 pages).
International Search Report for Application No. PCT/CA2009/001769, dated Apr. 8, 2010 (3 pages).
International Search Report for Application No. PCT/IB2010/055481, dated Apr. 7, 2011, 3 pages.
International Search Report for Application No. PCT/IB2010/055486, dated Apr. 19, 2011, 5 pages.
International Search Report for Application No. PCT/IB2014/060959, dated Aug. 28, 2014, 5 pages.
International Search Report for Application No. PCT/IB2010/055541 filed Dec. 1, 2010, dated May 26, 2011; 5 pages.
International Search Report for Application No. PCT/IB2011/050502, dated Jun. 27, 2011 (6 pages).
International Search Report for Application No. PCT/IB2011/051103, dated Jul. 8, 2011, 3 pages.
International Search Report for Application No. PCT/IB2011/055135, Canadian Patent Office, dated Apr. 16, 2012 (5 pages).
International Search Report for Application No. PCT/IB2012/052372, dated Sep. 12, 2012 (3 pages).
International Search Report for Application No. PCT/IB2013/054251, Canadian Intellectual Property Office, dated Sep. 11, 2013; (4 pages).
International Search Report for Application No. PCT/JP02/09668, dated Dec. 3, 2002, (4 pages).
International Written Opinion for Application No. PCT/CA2004/001742, Canadian Patent Office, dated Feb. 21, 2005 (5 pages).
International Written Opinion for Application No. PCT/CA2005/001897, dated Mar. 21, 2006 (4 pages).
International Written Opinion for Application No. PCT/CA2009/000501 dated Jul. 30, 2009 (6 pages).
International Written Opinion for Application No. PCT/IB2010/055481, dated Apr. 7, 2011, 6 pages.
International Written Opinion for Application No. PCT/IB2010/055486, dated Apr. 19, 2011, 8 pages.
International Written Opinion for Application No. PCT/IB2010/055541, dated May 26, 2011; 6 pages.
International Written Opinion for Application No. PCT/IB2011/050502, dated Jun. 27, 2011 (7 pages).
International Written Opinion for Application No. PCT/IB2011/051103, dated Jul. 8, 2011, 6 pages.
International Written Opinion for Application No. PCT/IB2011/055135, Canadian Patent Office, dated Apr. 16, 2012 (5 pages).
International Written Opinion for Application No. PCT/IB2012/052372, dated Sep. 12, 2012 (6 pages).
International Written Opinion for Application No. PCT/IB2013/054251, Canadian Intellectual Property Office, dated Sep. 11, 2013; (5 pages).
Jafarabadiashtiani : "A New Driving Method for a-Si AMOLED Displays Based on Voltage Feedback"; dated 2005 (4 pages).
Kanicki, J., "Amorphous Silicon Thin-Film Transistors Based Active-Matrix Organic Light-Emitting Displays." Asia Display: International Display Workshops, Sep. 2001 (pp. 315-318).
Karim, K. S., "Amorphous Silicon Active Pixel Sensor Readout Circuit for Digital Imaging." IEEE: Transactions on Electron Devices. vol. 50, No. 1, Jan. 2003 (pp. 200-208).
Lee : "Ambipolar Thin-Film Transistors Fabricated by PECVD Nanocrystalline Silicon"; dated 2006.
Lee, Wonbok: "Thermal Management in Microprocessor Chips and Dynamic Backlight Control in Liquid Crystal Displays", Ph.D. Dissertation, University of Southern California (124 pages).
Liu, P. et al., Innovative Voltage Driving Pixel Circuit Using Organic Thin-Film Transistor for AMOLEDs, Journal of Display Technology, vol. 5, Issue 6, Jun. 2009 (pp. 224-227).
Ma E Y: "organic light emitting diode/thin film transistor integration for foldable displays" dated Sep. 15, 1997(4 pages).
Matsueda y : "35.1: 2.5-in. AMOLED with Integrated 6-bit Gamma Compensated Digital Data Driver"; dated May 2004.
Mendes E., "A High Resolution Switch-Current Memory Base Cell." IEEE: Circuits and Systems. vol. 2, Aug. 1999 (pp. 718-721).
Nathan A. , "Thin Film imaging technology on glass and plastic" ICM 2000, proceedings of the 12 international conference on microelectronics, dated Oct. 31, 2001 (4 pages).
Nathan , "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan : "Backplane Requirements for active Matrix Organic Light Emitting Diode Displays,"; dated 2006 (16 pages).
Nathan : "Call for papers second international workshop on compact thin-film transistor (TFT) modeling for circuit simulation"; dated Sep. 2009 (1 page).
Nathan : "Driving schemes for a-Si and LTPS AMOLED displays"; dated Dec. 2005 (11 pages).
Nathan : "Invited Paper: a-Si for AMOLED—Meeting the Performance and Cost Demands of Display Applications (Cell Phone to HDTV)"; dated 2006 (4 pages).
Office Action in Japanese patent application No. JP2012-541612 dated Jul. 15, 2014. (3 pages).
Partial European Search Report for Application No. EP 11 168 677.0, dated Sep. 22, 2011 (5 pages).
Partial European Search Report for Application No. EP 11 19 1641.7, dated Mar. 20, 2012 (8 pages).
Philipp: "Charge transfer sensing" Sensor Review, vol. 19, No. 2, Dec. 31, 1999 (Dec. 31, 1999), 10 pages.
Rafati : "Comparison of a 17 b multiplier in Dual-rail domino and in Dual-rail D L (D L) logic styles"; dated 2002 (4 pages).
Safavian : "3-TFT active pixel sensor with correlated double sampling readout circuit for real-time medical x-ray imaging"; dated Jun. 2006 (4 pages).
Safavian : "A novel current scaling active pixel sensor with correlated double sampling readout circuit for real time medical x-ray imaging"; dated May 2007 (7 pages).
Safavian : "A novel hybrid active-passive pixel with correlated double sampling CMOS readout circuit for medical x-ray imaging"; dated May 2008 (4 pages).
Safavian : "Self-compensated a-Si:H detector with current-mode readout circuit for digital X-ray fluoroscopy"; dated Aug. 2005 (4 pages).
Safavian : "TFT active image sensor with current-mode readout circuit for digital x-ray fluoroscopy [5969D-82]"; dated Sep. 2005 (9 pages).
Safavian : "Three-TFT image sensor for real-time digital X-ray imaging"; dated Feb. 2, 2006 (2 pages).
Singh "Current Conveyor: Novel Universal Active Block", Samriddhi, S-JPSET vol. I, Issue 1, 2010, pp. 41-48 (12EPPT).
Smith, Lindsay I., "A tutorial on Principal Components Analysis," dated Feb. 26, 2001 (27 pages).
Spindler , System Considerations for RGBW OLED Displays, Journal of the SID 14/1, 2006, pp. 37-48.
Stewart M. , "polysilicon TFT technology for active matrix oled displays" IEEE transactions on electron devices, vol. 48, No. 5, dated May 2001 (7 pages).
Vygranenko : "Stability of indium-oxide thin-film transistors by reactive ion beam assisted deposition"; dated 2009.
Wang : "Indium oxides by reactive ion beam assisted evaporation: From material study to device application"; dated Mar. 2009 (6 pages).
Yi He , "Current-Source a-Si:H Thin Film Transistor Circuit for Active-Matrix Organic Light-Emitting Displays", IEEE Electron Device Letters, vol. 21, No. 12, Dec. 2000, pp. 590-592.
Yu, Jennifer: "Improve OLED Technology for Display", Ph.D. Dissertation, Massachusetts Institute of Technology, Sep. 2008 (151 pages).
International Search Report for Application No. PCT/IB2014/058244, Canadian Intellectual Property Office, dated Apr. 11, 2014; (6 pages).
International Search Report for Application No. PCT/IB2014/059753, Canadian Intellectual Property Office, dated Jun. 23, 2014; (6 pages).
Written Opinion for Application No. PCT/IB2014/059753, Canadian Intellectual Property Office, dated Jun. 12, 2014 (6 pages).

(56) References Cited

OTHER PUBLICATIONS

International Search Report for Application No. PCT/IB2014/060879, Canadian Intellectual Property Office, dated Jul. 17, 2014 (3 pages).
Extended European Search Report for Application No. EP 14158051.4, dated Jul. 29, 2014, (4 pages).
Office Action in Chinese Patent Invention No. 201180008188.9, dated Jun. 4, 2014 (17 pages) (w/English translation).
International Search Report for Application No. PCT/IB/2014/066932 dated Mar. 24, 2015.
Written Opinion for Application No. PCT/IB/2014/066932 dated Mar. 24, 2015.
Extended European Search Report for Application No. EP 11866291.5, dated Mar. 9, 2015, (9 pages).
Extended European Search Report for Application No. EP 14181848.4, dated Mar. 5, 2015, (8 pages).
Office Action in Chinese Patent Invention No. 201280022957.5, dated Jun. 26, 2015 (7 pages).
Extended European Search Report for Application No. EP 13794695.0, dated Dec. 18, 2015, (9 pages).
Extended European Search Report for Application No. EP 16157746.5, dated Apr. 8, 2016, (11 pages).
Extended European Search Report for Application No. EP 16192749.6, dated Dec. 15, 2016, (17 pages).
International Search Report for Application No. PCT/IB/2016/054763 dated Nov. 25, 2016 (4 pages).
Written Opinion for Application No. PCT/IB/2016/054763 dated Nov. 25, 2016 (9 pages).

* cited by examiner

OLED LUMINANCE DEGRADATION COMPENSATION

CROSS REFERENCE TO RELATED APPLICATIONS

This application is a continuation of U.S. patent application Ser. No. 14/813,904, filed Jul. 30, 2015, now allowed, which is a continuation of U.S. patent application Ser. No. 14/052,146, filed Oct. 11, 2013, now U.S. Pat. No. 9,125,278, issued Sep. 1, 2015, which is a continuation of U.S. patent application Ser. No. 13/632,691, filed Oct. 1, 2012, now U.S. Pat. No. 8,581,809, issued Nov. 12, 2013, which is a continuation of U.S. patent application Ser. No. 13/179,963, filed Jul. 11, 2011, now U.S. Pat. No. 8,279,143, issued Oct. 2, 2012, which is a continuation of U.S. patent application Ser. No. 11/839,145, filed Aug. 15, 2007 now U.S. Pat. No. 8,026,876, issued Sep. 27, 2011, which claims priority to Canadian Patent Application No. 2,556,961, filed Aug. 15, 2006; the entire contents of which are incorporated herein by reference.

FIELD OF THE INVENTION

The present invention relates to OLED displays, and in particular to the compensation of luminance degradation of the OLED based on OLED capacitance.

BACKGROUND

Organic light emitting diodes ("OLEDs") are known to have many desirable qualities for use in displays. For example, they can produce bright displays, they can be manufactured on flexible substrates, they have low power requirements, and they do not require a backlight. OLEDs can be manufactured to emit different colours of light. This makes possible their use in full colour displays. Furthermore, their small size allows for their use in high resolution displays.

The use of OLEDs in displays is currently limited by, among other things, their longevity. As the OLED display is used, the luminance of the display decreases. In order to produce a display that can produce the same quality of display output repeatedly over a period of time (for example, greater then 1000 hours) it is necessary to compensate for this degradation in luminance.

One method of determining the luminance degradation is by measuring it directly. This method measures the luminance of a pixel for a given driving current. This technique requires a portion of each pixel to be covered by the light detector. This results in a lower aperture and resolution.

Another technique is to predict the luminance degradation based on the accumulated drive current applied to the pixel. This technique suffers in that if the information pertaining to the accumulated drive current is lost or corrupted (such as by power failure) the luminance correction cannot be performed.

There is therefore a need for a method and associated system for determining the luminance degradation of an OLED that does not result in a decrease in the aperture ratio, yield or resolution and that does not rely on information about the past operation of the OLED to compensate for the degradation.

SUMMARY

In one embodiment there is provided a method of compensating for luminance degradation of a pixel. The method comprises determining the capacitance of the pixel, and correlating the determined capacitance of the pixel to a current correction factor for the pixel.

In another embodiment there is provided a method of driving a pixel with a current compensated for luminance degradation of the pixel. The method comprises determining the capacitance of the pixel, correlating the determined capacitance of the pixel to a current correction factor for the pixel, compensating a pixel drive current according to the current correction factor, and driving the pixel with the compensated current.

In yet another embodiment there is provided a read block for use in determining a pixel capacitance of a plurality of pixel circuits. The pixel circuits are arranged in an array to form a display. The read block comprises a plurality of read block elements. Each read block element comprises a switch for electrically connecting and disconnecting the read block element to a pixel circuit of the plurality of pixels circuits, an operational amplifier electrically connected to the switch and a read capacitor connected in parallel with the operational amplifier.

In still another embodiment there is provided a display for driving an array of a plurality of pixel circuits with a current compensated for luminance degradation. The display comprises a display panel comprising the array of pixel circuits, the pixel circuits arranged in at least one row and a plurality of columns, a column driver for driving the pixel circuits with a driving current, a read block for determining a pixel capacitance of the pixel circuits, and a control block for controlling the operation of the column driver and the read block, the control block operable to determine a current correction factor from the determined pixel capacitance and to adjust the driving current based on the current correction factor.

BRIEF DESCRIPTION OF THE DRAWINGS

Features and embodiments will be described with reference to the drawings wherein.

DETAILED DESCRIPTION

Figure 1:
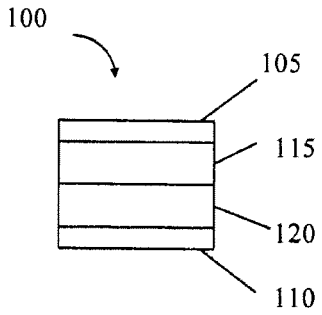
FIG. 1 is a block diagram illustrating the structure of an organic light emitting diode.

FIG. 1 shows, in a block diagram, the structure of an organic light emitting diode ("OLED") 100. The OLED 100 may be used as a pixel in a display device. The following description refers to pixels, and will be appreciated that the pixel may be an OLED. The OLED 100 comprises two electrodes, a cathode 105 and an anode 110. Sandwiched between the two electrodes are two types of organic material. The organic material connected to the cathode 105 is an emissive layer and is typically referred to as a hole transport layer 115. The organic material connected to the anode 110 is a conductive layer and is typically referred to as an electron transport layer 120. Holes and electrons may be injected into the organic materials at the electrodes 105, 110. The holes and electrons recombine at the junction of the two organic materials 115, 120 resulting in the emission of light.

The anode 110 may be made of a transparent material such as indium tin oxide. The cathode 105 does not need to be made of a transparent material. It is typically located on the back of the display panel, and may be referred to as the back plane electronics. In addition to the cathode 105, the back plane electronics may also include transistors and other elements used to control the functioning of the individual pixels.

Figure 2:
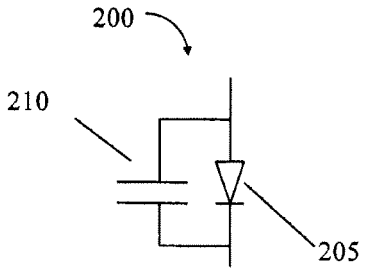
FIG. 2 is a schematic illustrating a circuit model of an OLED pixel.

FIG. 2 shows, in a schematic, a circuit model of an OLED pixel 200. The pixel may be modeled by an ideal diode 205 connected in parallel with a capacitor 210 having a capacitance $C_{oled}$. The capacitance is a result of the physical and electrical characteristics of the OLED. When a current passes through the diode 205 (if the diode is an LED) light is emitted. The intensity of the light emitted (the luminance of the pixel) depends on at least the age of the OLED and the current driving the OLED. As OLEDs age, as a result of being driven by a current for periods of time, the amount of current required to produce a given luminance increases.

In order to produce a display that can reproduce an output consistently over a period of time, the amount of driving current necessary to produce a given luminance must be determined. This requires accounting for the luminance degradation resulting from the aging of the pixel. For example, if a display is to produce an output of X cd/m$^2$ in brightness for 1000 hours, the amount of current required to drive each pixel in the display will increase as the pixels of the display age. The amount that the current must be increased by to produce the given luminance is referred to herein as a current correction factor. The current correction factor may be an absolute amount of current that needs to be added to the signal current in order to provide the compensated driving current to the pixel. Alternatively the current correction factor may be a multiplier. This multiplier may indicate for example that the signal current be doubled to account for the pixel aging. Alternatively the current correction factor may be used in a manner similar to a lookup table to directly correlate a signal current (or desired luminance) with a compensated driving current necessary to produce the desired luminance level in the aged pixel.

As described further herein it is possible to use the change of the pixel's capacitance over time as a feedback signal to stabilize the degradation of the pixel's luminance.

Figure 3A:
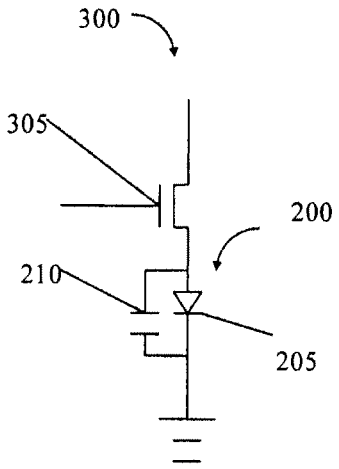
FIG. 3*a* is a schematic illustrating a simplified pixel circuit that can be used in a display.

FIG. 3*a* shows, in a schematic, a simplified pixel circuit 300 that can be used for driving a pixel 200. The transistor 305 acts as a switch for turning on the pixel 200 (shown in FIG. 2). A driving current passes through the transistor 305 to drive the output of the pixel 200.

Figure 3B:
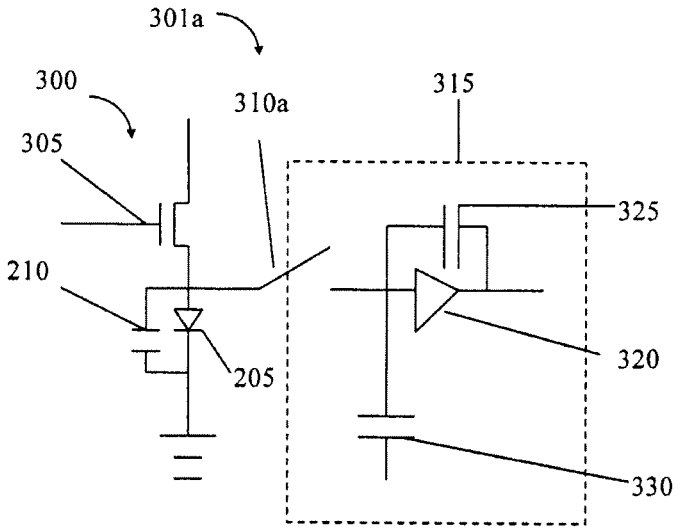
FIG. 3*b* is a schematic illustrating a modified and simplified pixel circuit.

FIG. 3*b* shows, in a schematic, a simplified pixel circuit 301*a*, which has been modified in accordance with methods of present invention. A read block 315 is connected to the pixel circuit 300 of FIG. 3*a* through a switch 310*a*. The read block 315 allows for the capacitance 210 of the pixel 200 to be determined. The read block 315 comprises an op amp 320 connected in parallel with a reading block capacitor 325. This configuration may be referred to as a charge amplifier. The circuit also has an inherent parasitic capacitance 330. The circuit elements of the read block 315 may be implemented in the display panel's back plane electronics. Alternatively, the read block elements may be implemented off the display panel. In one embodiment the read block 315 is incorporated into the column driving circuitry of the display.

If the read block 315 circuitry is implemented separately from the back plane circuitry of the display panel, the switch 310*a* may be implemented in the back plane electronics. Alternatively, the switch 310*a* may also be implemented in the separate read block 315. If the switch 310*a* is implemented in the separate read block 315 it is necessary to provide an electrical connection between the switch 310*a* and the pixel circuit 300.

Figure 3C:
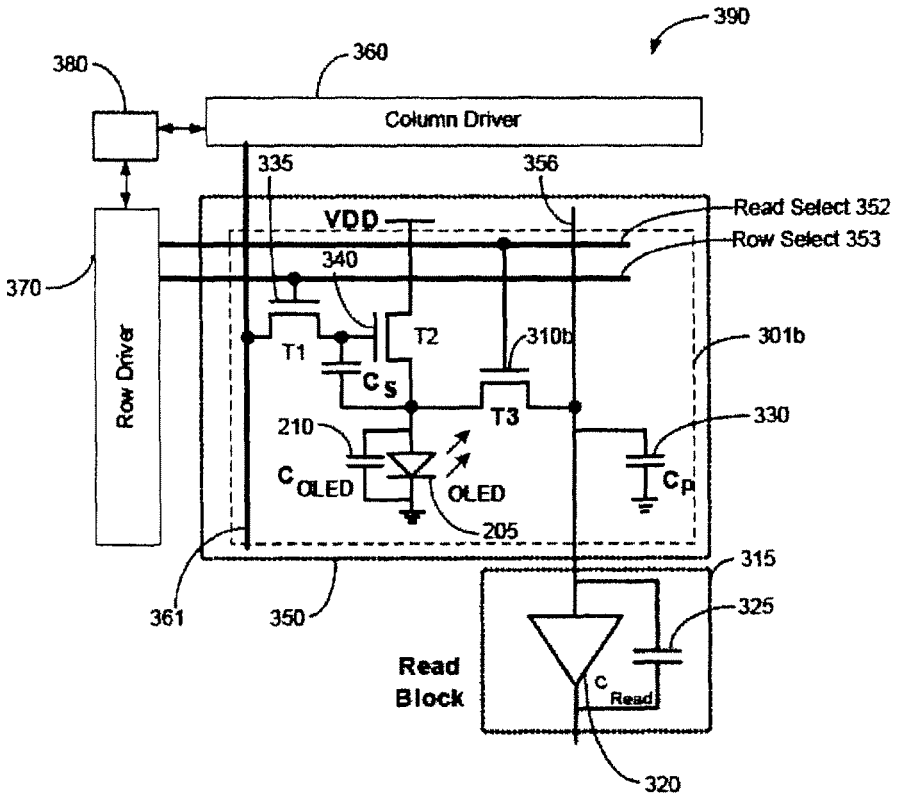
FIG. 3*c* is a schematic illustrating a display, comprising a single pixel.

FIG. 3*c* shows, in a schematic, a display 390, comprising a single pixel circuit 301*b* for clarity of the description. The display 390 comprises a row driver 370, a column driver 360, a control block 380, a display panel 350 and a read block 315. The read block 315 is shown as being a separate component. As previously described, it will be appreciated that the read block circuitry may be incorporated into the other components of the display 390.

The single transistor 305 controlling the driving of the pixel 200 shown in FIG. 3*b* is replaced with two transistors. The first transistor T1 335 acts as a switching transistor controlled by the row drivers 370. The second transistor T2 340 acts as a driving transistor to supply the appropriate current to the pixel 200. When T1 335 is turned on it allows the column drivers 360 to drive the pixel of pixel circuit 301*b* with the drive current (compensated for luminance degradation) through transistor T2 340. The switch 310*a* of FIG. 3*b* has been replaced with a transistor T3 310*b*. The control block 380 controls transistor T3 310*b*. Transistor T3 310*b* may be turned on and off to electrically connect the read block 315 to the pixel circuit.

The Row Select 353 and Read Select 352 lines may be driven by the row driver 370. The Row Select line 353 controls when a row of pixels is on. The Read Select line 352 controls the switch (transistor T3) 310 that connects the read block 315 with the pixel circuit. The Column Driver line 361 is driven by the column driver 360. The Column Driver line 361 provides the compensated driving current for driving the pixel 200 brightness. The pixel circuit also comprises a Read Block line 356. The pixel circuit is connected to the Read Block line 356 by the transistor T3 310*b*. The Read Block line 356 connects the pixel circuit to the read block 315.

The control block 380 of the display 390 controls the functioning of the various blocks of the display 390. The column driver 360 provides a driving current to the pixel 200. It will be appreciated that the current used to drive the pixel 200 determines the brightness of the pixel 200. The row drivers 370 determine which row of pixels will be driven by the column drivers 360 at a particular time. The control block 380 coordinates the column 360 and row drivers 370 so that a row of pixels is turned on and driven by an appropriate current at the appropriate time to produce a desired output. By controlling the row 370 and column drivers 360 (for example, when a particular row is turned on and what current drives each pixel in the row) the control block 380 controls the overall functioning of the display panel 350.

The display 390 of FIG. 3*c* may operate in at least two modes. The first mode is a typical display mode, in which the control block 380 controls the row 370 and column drivers 360 to drive the pixels 200 for displaying an appropriate output. In the display mode the read block 315 is not electrically connected to the pixel circuits as the control block 380 controls transistor T3 310*b* so that the transistor T3 310*b* is off. The second mode is a read mode, in which the control block 380 also controls the read block 315 to determine the capacitance of the pixel 200. In the read mode, the control block 380 turns on and off transistor T3 310*b* as required.

Figure 4:
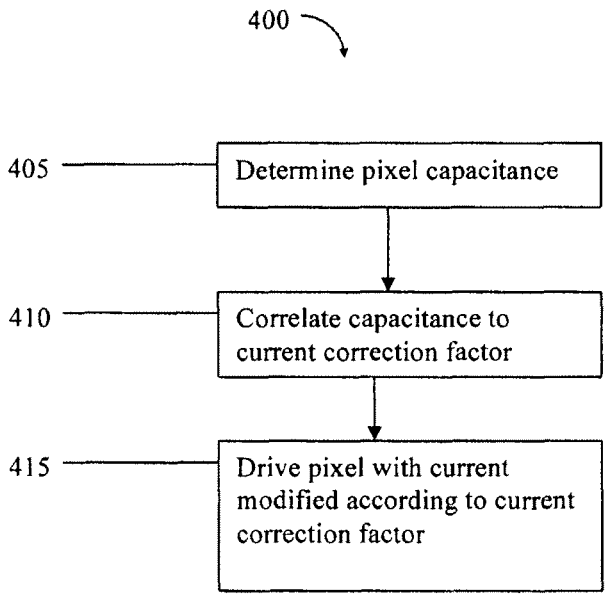
FIG. 4 is a flow diagram illustrating the steps for driving a pixel with a current compensated to account for the luminance degradation of the pixel.

FIG. 4 shows, in a flow diagram 400, the steps for driving a pixel with a current compensated to account for the luminance degradation of the pixel. The capacitance of the pixel is determined in step 405. The determined capacitance is then correlated to a current correction factor in step 410. This correlation may be done in various ways, such as through the solving of equations modeling the aging of the pixel type, or through a lookup means for directly correlating a capacitance to a current correction factor in step 415.

When determining the capacitance of a pixel of a display as shown in FIG. 3*c*, the switch is initially closed (transistor T3 310*b* is on), electrically connecting the pixel circuit to the read block 315 through the Read Block line 356, and the capacitance 210 of the pixel is charged to an initial voltage V1 determined by the bias voltage of the read block 315 (e.g. charge amplifier). The switch is then opened (transistor T3 is turned off), disconnecting the pixel circuit from the Read Block line 356 and in turn the read block 315. The parasitic capacitance 330 of the read block 315 (or Read Block line 356) is then charged to another voltage V2, determined by the bias voltage of the read block 315 (e.g. charge amplifier). The bias voltage of read block 315 (e.g. charge amplifier) is controlled by the control block 380, and may therefore be different from the voltage used to charge the pixel capacitance 210. Finally, the switch is closed again, electrically connecting the read block 315 to the pixel circuit. The pixel capacitance 210 is then charged to V2. The amount of charge required to change the voltage at Cored from V1 to V2 is stored in the read capacitor 325 which can be read as a voltage.

The accuracy of the method may be increased by waiting for a few micro seconds between the time the parasitic capacitance 330 is charged to voltage V2 and when the switch 310 is closed to electrically connect the read block 315 to the pixel circuit. In the few microseconds the leakage current of the read capacitor 315 can be measured, a resultant voltage determined and deducted from the final voltage seen across the read capacitor 315.

The change in voltage across the read capacitor 315 is measured once the switch 310 is closed. Once the pixel capacitance 210 and the parasitic capacitance 330 are charged to the same voltage, the voltage change across the read capacitor 325 may be used to determine the capacitance 210 of the pixel 200. The voltage change across the read capacitor 325 changes according to the following equation:

$$\Delta Vc_{read} = -\frac{C_{oled}}{C_{read}}(V1 - V2)$$

where:

$\Delta V_{Cread}$ is the voltage change across the read capacitor 325 from when the switch 310 is closed, connecting the charged parasitic 330 and pixel capacitances 210, to when the voltage across the two capacitances is equal;

$C_{oled}$ is the capacitance 210 of the pixel (in this case an OLED);

$C_{read}$ is the capacitance of the read capacitor 325;

V1 is the voltage that the pixel capacitance 210 is initially charged to; and V2 is the voltage that the parasitic capacitance 330 is charged to once the switch is opened.

The voltages V1 and V2 will be known and may be controlled by the control block 380. $C_{read}$ is known and may be selected as required to meet specific circuit design requirements. $\Delta C_{read}$ is measured from the output of the op amp 320. From the above equation, it is clear that as $C_{oled}$ decreases, $\Delta VC_{read}$ decreases as well. Furthermore the gain is determined by V1, V2 and $C_{read}$. The values of V1 and V2 may be controlled by the control block 380 (or wherever the circuit is that controls the voltage). It will be appreciated that the measurement may be made by converting the analog signal of the op amp 320 into a digital signal using techniques known by those skilled in the art.

Figure 5:
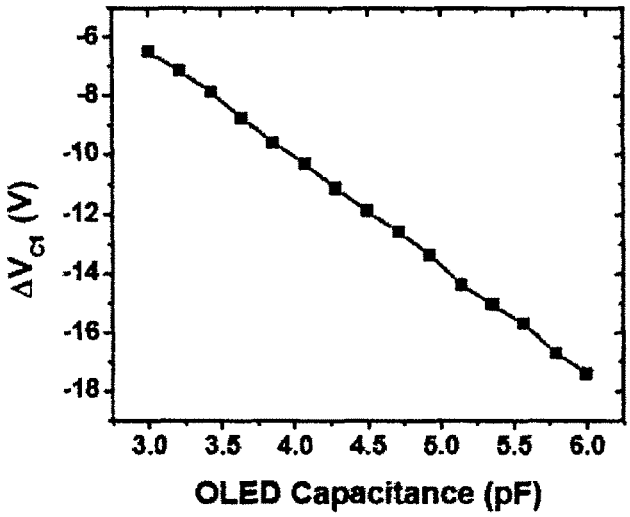
FIG. 5 is a graph illustrating the simulated change in voltage across the read capacitor using the read block circuit.

FIG. 5 shows, in a graph, the simulated change in voltage across the read capacitor 325 using the read block 315 circuit described above. From the graph it is apparent that the read block 315 may be used to determine the capacitance 210 of the pixel 200 based on the measured voltage change across the read capacitor 325.

Once the capacitance 210 of the pixel 200 is determined it may be used to determine the age of the pixel 200. As previously described, the relationship between the capacitance 210 and age of a pixel 200 may be determined experimentally for different pixel types by stressing the pixels with a given current and measuring the capacitance of the pixel periodically. The particular relationship between the capacitance and age of a pixel will vary for different pixel types and sizes and can be determined experimentally to ensure an appropriate correlation can be made between the capacitance and the age of the pixel.

The read block 315 may contain circuitry to determine the capacitance 210 of the pixel 200 from the output of the operational amplifier 320. This information would then be provided to the control block 380 for determining the current correction factor of the pixel 200. Alternatively, the output of the operational amplifier 320 of the read block 315 may be provided back to the control block 380. In this case, the control block 380 would comprise the circuitry and logic necessary to determine the capacitance 210 of the pixel 200 and the resultant current correction factor.

Figure 6:
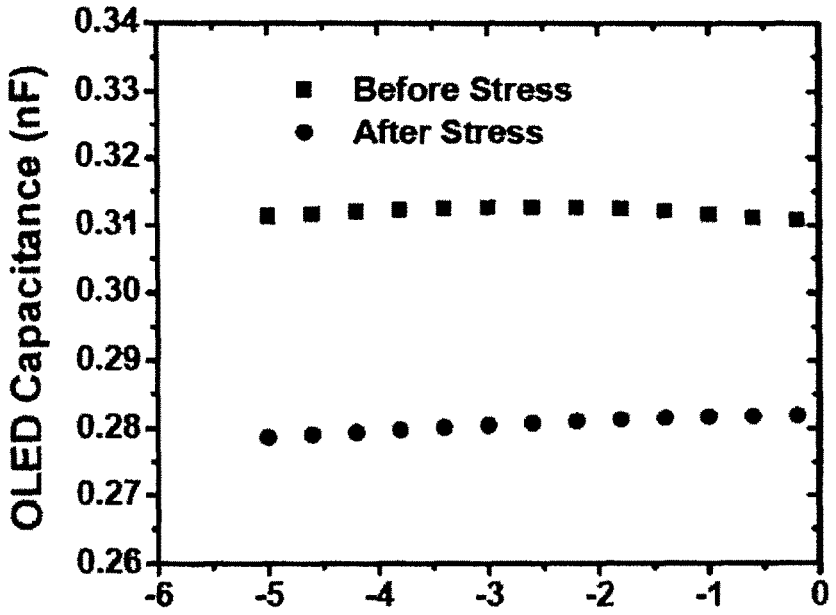
FIG. 6 is a graph illustrating the relationship between the capacitance and voltage of a pixel of different ages.

FIG. 6 shows, in a graph, the relationship between the capacitance and voltage of a pixel before and after aging. The aging was caused by stressing the pixel with a constant current of 20 mA/cm$^2$ for a week. The capacitance may be linearly related to the age. Other relationships are also possible, such as a polynomial relationship. Additionally, the relationship may only be able to be represented correctly by experimental measurements. In this case additional measurements are required to ensure that the modeling of the capacitance-age characteristics are accurate.

Figure 7:
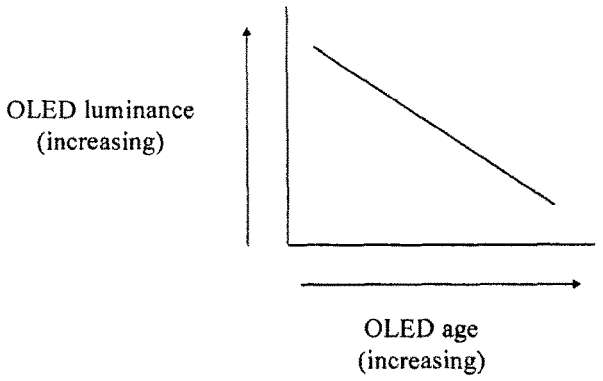
FIG. 7 is a graph illustrating the relationship between the luminance and age of a pixel.

FIG. 7 shows, in a graph, the relationship between the luminance and age of a pixel. This relationship may be determined experimentally when determining the capacitance of the pixel. The relationship between the age of the pixel and the current required to produce a given luminance may also be determined experimentally. The determined relationship between the age of the pixel and the current required to produce a given luminance may then be used to compensate for the aging of the pixel in the display.

A current correction factor may be used to determine the appropriate current at which to drive a pixel in order to produce the desired luminance. For example, it may be determined experimentally that in order to produce the same luminance in a pixel that has been aged (for example by driving it with a current of 15 mA/cm$^2$ for two weeks) as that of a new pixel, the aged pixel must be driven with 1.5 times the current. It is possible to determine the current required for a given luminance at two different ages, and assume that the aging is a linear relationship. From this, the current correction factor may be extrapolated for different ages. Furthermore, it may be assumed that the current correction factor is the same at different luminance levels for a pixel of a given age. That is, in order to produce a luminance of X cd/m$^2$ requires a current correction factor of 1.1 and that in order to produce a luminance of 2X cd/m$^2$ also requires a current correction factor of 1.1 for a pixel of a given age. Making these assumptions reduces the amount of measurements that are required to be determined experimentally.

Additional information may be determined experimentally, which results in not having to rely on as many assumptions. For example the pixel capacitance 210 may be determined at four different pixel ages (it is understood that the capacitance could be determined at as many ages as required to give the appropriate accuracy). The aging process may then be modeled more accurately, and as a result the extrapolated age may be more accurate. Additionally, the current correction factor for a pixel of a given age may be determined for different luminance levels. Again, the additional measurements make the modeling of the aging and current correction factor more accurate.

It will be appreciated that the amount of information obtained experimentally may be a trade off between the time necessary to make the measurements, and the additional accuracy the measurements provide.

Figure 8:
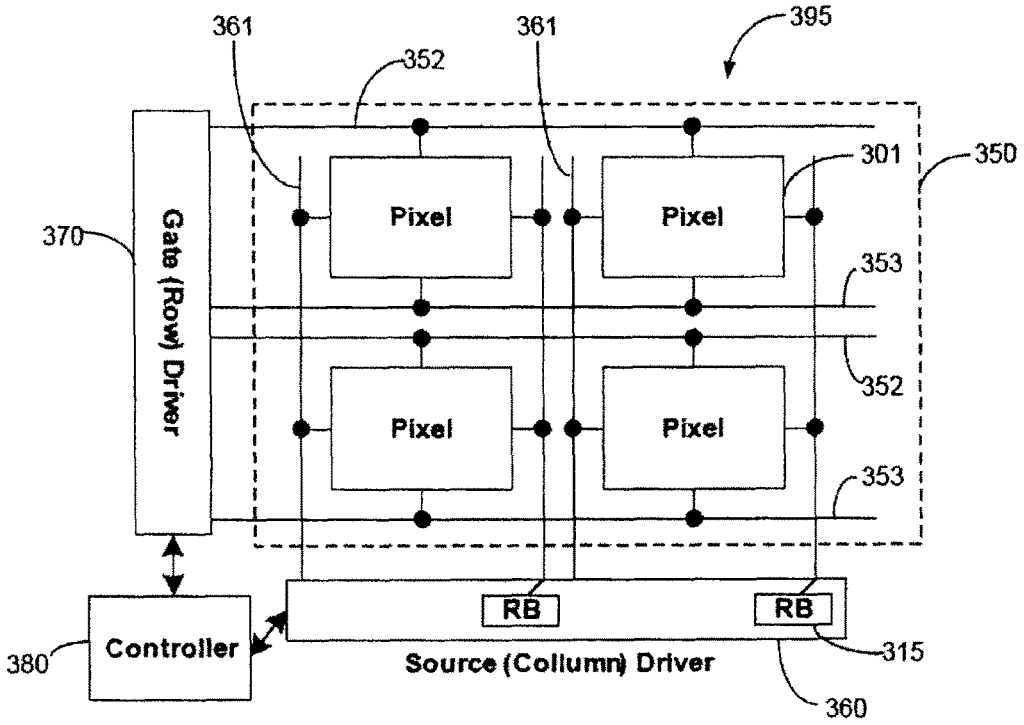
FIG. 8 is a block diagram illustrating a display.

FIG. 8 shows, in a block diagram, a display 395. The display 395 comprises a display panel 350, a row driver block 370, a column driver block 360 and a control block 380. The display panel 350 comprises an array of pixel circuits 301*b* arranged in row and columns. The pixel circuits 301*a* of the display panel 350 depicted in FIG. 8 are implemented as shown in FIG. 3*c*, and described above. In the typical display mode, transistor T3 310*b* is off and the control block 380 controls the row driver 360 so that the Read Select line 352 is driven so as to turn off transistor T3 310*b*. The control block 380 controls the row driver 370 so that the row driver 370 drives the Row Select line 353 of the appropriate row so as to turn on the pixel row. The control block 380 then controls the column drivers 360 so that the appropriate current is driven on the Column Drive line 361 of the pixel. The control block 380 may refresh each row of the display panel 350 periodically, for example 60 times per second.

When the display 395 is in the read mode, the control block 380 controls the row driver 370 so that it drives the Read Select line 352 (for turning on and off the switch, transistor T3 310) and the bias voltage of the read block 315 (and so the voltage of the Read Block line 356) for charging the capacitances to V1 and V2 as required to determine the capacitance 210 of the pixel 200, as described above. The control block 380 performs a read operation to determine the capacitance 210 of each pixel 200 of a pixel circuit 301*b* in a particular row. The control block then uses this information to determine the age of the pixel, and in turn a current correction factor that is to be applied to the driving current.

In addition to the logic for controlling the drivers 360, 370 and read block 315, the control block 380 also comprises logic for determining the current correction factor based on the capacitance 210 as determined with the read block 315. As described above, the current correction factor may be determined using different techniques. For example, if the pixel is measured to determine its initial capacitance and its capacitance after aging for a week, the control block 380 can be adapted to determine the age of a particular capacitance by solving a linear equation defined by the two measured capacitances and ages. If the required current correction factor is measured for a single luminance at each level, than the current correction factor can be determined for a pixel using a look-up table that gives the current correction factor for a particular pixel age. The control block 380 may receive a pixel's capacitance 210 from the read block 315 and determine the pixel's age by solving a linear equation defined by the two measured capacitances for the different ages of the pixel. From the determined age the control block 315 determines a current correction factor for the pixel using a look-up table.

If additional measurements of the pixel aging process were taken, then determining the age of the pixel may not be as simple as solving a linear equation. For example if three points P1, P2 and P3 are taken during the aging process such that the aging is linear between the points P1 and P2, but is exponential or non-linear between points P2 and P3, determining the age of the pixel may require first determining what range the capacitance is in (i.e. between P1-P2, or P2-P3) and then determining the age as appropriate.

The method used by the control block 380 for determining the age of a pixel may vary depending on the requirements of the display. How the control block 380 determines the pixel age and the information required to do so would be programmed into the logic of the control block. The required logic may be implemented in hardware, such as an ASIC (Application Specific Integrated Circuit), in which case it may be more difficult to change how the control block 380 determines the pixel age. The required logic could be implemented in a combination of hardware and software so that it is easier to modify how the control block 380 determines the age of the pixel.

In addition to the various ways to correlate the capacitance to age, the control block 380 may determine the current correction factor in various ways. As previously described, current correction factors may be determined for various luminance levels. Like with the age-capacitance correlation, the current correction factor for a particular luminance level may be extrapolated from the available measurements. Similar to the capacitance-age correlation, the specifics on how the control block 380 determines the current correction factor can vary, and the logic required to determine the current correction factor can be programmed into the control block 380 in either hardware or software Once a current correction factor is determined for a pixel, it is used to scale the driving current as required.

Figure 9:
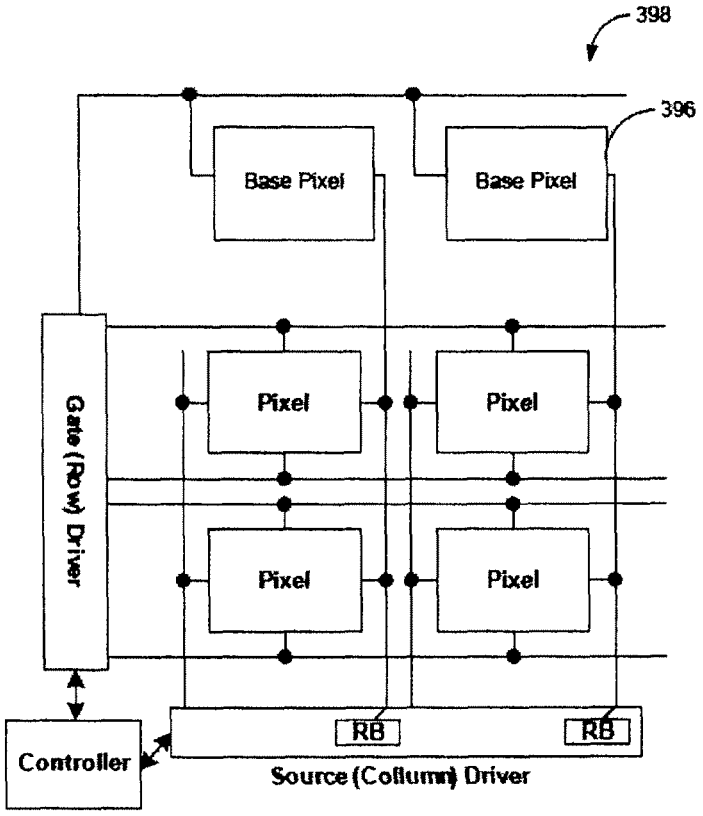
FIG. 9 is a block diagram illustrating an embodiment of a display.

FIG. 9 shows in a block diagram an embodiment of a display 398. The display 390 described above, with reference to FIG. 8, may be modified to correct for pixel characteristics common to the pixel type. For example, it is known that the characteristics of pixels depend on the temperature of the operating environment. In order to determine the capacitance that is the result of aging, the display 398 is provided with an additional row of pixels 396. These pixels 396, referred to as base pixels, are not driven by display currents, as a result they do not experience the aging that the display pixels experience. The base pixels 396 may be connected to the read block 315 for determining their capacitance. Instead of using the pixel capacitance directly, the control block 380 may then use the difference between the pixel capacitance 210 and the base capacitance as the capacitance to use when determining the age of the display pixel.

This provides the ability to easily combine different corrections together. Since the age of the pixel was determined based on a capacitance corrected to account for the base pixel capacitance, the age correction factor does not include correction for non-aging factors. For example, a current correction factor may be determined that is the sum of two current correction factors. The first may be the age-related current correction factor described above. The second may be an operating environment temperature related correction factor.

The control block 380 may perform a read operation (i.e. operate in the read mode) at various frequencies. For example, a read operation may be performed every time a frame of the display is refreshed. It will be appreciated that the time required to perform a read operation is determined by the components. For example, the settling time required for the capacitances to be charged to the desired voltage depends on the size of the capacitors. If the time is large relative to the frame refresh rate of the display, it may not be possible to perform a read each time the frame is refreshed. In this case the control block may perform a read, for example, when the display is turned on or off. If the read time is comparable to the refresh rate it may be possible to perform a read operation once a second. This may insert a blank frame into the display once every 60 frames. However, this may not degrade the display quality. The frequency of the read operations is dependent upon at least the components that make up the display and the required display characteristics (for example frame rate). If the read time is short compared to the refresh rate, a read may be performed prior to driving the pixel in the display mode.

The read block 315 has been described above as determining the capacitance 210 of a single pixel 200 in a row. A single read block 315 can be modified to determine the capacitance of multiple pixels in a row. This can be accomplished by including a switch (not shown) to determine what pixel circuit 301*b* the read block 315 is connected to. The switch may be controlled by the control block 380. Furthermore, although a single read block 315 has been described, it is possible to have multiple read blocks for a single display. If multiple read blocks are used, then the individual read blocks may be referred to as read block elements, and the group of multiple read block elements may be referred to as a read block.

Although the above description describes a circuit for determining the capacitance 210 of a pixel 200, it will be appreciated that other circuits or methods could be used for determining the pixel capacitance 210. For example in place of the voltage amplifier configuration of the read block 315, a transresistance amplifier may be used to determine the capacitance of the pixel. In this case the capacitance of the pixel and the parasitic capacitance is charged using a varying voltage signal, such as a ramp or sinusoidal signal. The resultant current can be measured and the capacitance determined. Since the capacitance is a combination of the parasitic capacitance 330 and the pixel capacitance 210, the parasitic capacitance 330 must be known in order to determine the pixel capacitance 210. The parasitic capacitance 330 may be determined by direct measurement. Alternatively or additionally the parasitic capacitance 330 may be determined using the transresistance amplifier configuration read block. A switch may disconnect the pixel circuit from the read block. The parasitic capacitance 330 would then be determined by charging it with a varying voltage signal and measuring the resultant current.

The embodiments described herein for compensating for the luminance degradation of pixels due to electrical aging can be advantageously included in a display panel without decreasing the yield, aperture ratio or resolution of the display. The electronics required to implement the technique can easily be included in the electronics required by the display without significantly increasing the display size or power requirements.

One or more currently illustrated embodiments have been described by way of example. It will be apparent to persons skilled in the art that a number of variations and modifications can be made without departing from the scope of the invention as defined in the claims.

What is claimed is:

1. A method of driving a pixel, the method comprising:
electrically coupling the pixel to read block circuitry;
taking at least one reading from the pixel with the read block circuitry;
determining a capacitance of an electroluminescent device of the pixel with use of the at least one reading from the pixel; and
driving the pixel based on the determined capacitance and a relationship between an aging of the pixel and the capacitance of the electroluminescent device.

2. The method as claimed in claim 1, wherein driving the pixel based on the determined capacitance and the relationship between the aging of the pixel and the capacitance of the electroluminescent device comprises:
compensating a drive current for the pixel based on the determined capacitance and the relationship between the aging of the pixel and the capacitance of the electroluminescent device generating a compensated drive current; and
driving the pixel with the compensated drive current.

3. The method as claimed in claim 2, wherein compensating the drive current for the pixel based on the determined capacitance and the relationship between the aging of the pixel and the capacitance of the electroluminescent device comprises:
correlating the determined capacitance of the pixel to a current correlation factor for the pixel; and
compensating the drive current according to the current correlation factor for the pixel.

4. The method as claimed in claim 3, wherein the current correlation factor is an absolute amount of current to be added to the drive current to generate the compensated drive current.

5. The method as claimed in claim 3, wherein the current correlation factor is a multiplier by which the driver current is multiplied to generate the compensated drive current.

6. The method as claimed in claim 3, wherein the current correlation factor is retrieved from a lookup table that correlates desired luminance values with compensated driving currents, the lookup table being stored in a memory device.

7. A method of driving a pixel, the method comprising:
electrically coupling an electroluminescent device of the pixel to a read capacitor and charging the capacitance of the electroluminescent device with charge from the read capacitor;
determining the capacitance of the electroluminescent device from a change in charge stored in the read capacitor; and
driving the pixel based on said determined capacitance.

8. The method as claimed in claim 7, wherein determining the capacitance of the electroluminescent device from a change in charge stored in the read capacitor comprises:
measuring a change in voltage across the read capacitor; and determining the change in charge stored in the read capacitor from the change of voltage across the read capacitor.

9. A method of compensating a drive current for a pixel, the method comprising:

electrically coupling the pixel to read block circuitry;

taking at least one reading from the pixel with the read block circuitry;

determining a capacitance of an electroluminescent device of the pixel with use of the at least one reading from the pixel; and generating a compensated drive current by compensating a drive current for the pixel based on the determined capacitance and a relationship between an aging of the pixel and the capacitance of the electroluminescent device.

10. The method as claimed in claim 9, wherein compensating the drive current for the pixel based on the determined capacitance and the relationship between the aging of the pixel and the capacitance of the electroluminescent device comprises:

correlating the determined capacitance of the pixel to a current correlation factor for the pixel; and compensating the drive current according to the current correlation factor for the pixel.

11. The method as claimed in claim 10, wherein the current correlation factor is an absolute amount of current to be added to the drive current to generate the compensated drive current.

12. The method as claimed in claim 10, wherein the current correlation factor is a multiplier by which the driver current is multiplied to generate the compensated drive current.

13. The method as claimed in claim 10, wherein the current correlation factor is retrieved from a lookup table that correlates desired luminance values with compensated driving currents, the lookup table being stored in a memory device.

14. A method of compensating a drive current for a pixel, the method comprising:

electrically coupling an electroluminescent device of the pixel to a read capacitor and charging the capacitance of the electroluminescent device with charge from the read capacitor;

determining the capacitance of the electroluminescent device from a change in charge stored in the read capacitor and generating a compensated drive current by compensating a drive current for the pixel based on the determined capacitance.

15. The method as claimed in claim 14, wherein determining the capacitance of the electroluminescent device from a change in charge stored in the read capacitor comprises:

measuring a change in voltage across the read capacitor; and determining the change in charge stored in the read capacitor from the change in voltage across the read capacitor.

16. A method of determining a capacitance of an electroluminescent device of a pixel, the method comprising:

electrically coupling the electroluminescent device to a read capacitor and charging the capacitance of the electroluminescent device with charge from the read capacitor; and determining the capacitance of the electroluminescent device from a change in charge stored in the read capacitor.

17. The method as claimed in claim 16, wherein determining the capacitance of the electroluminescent device from a change in charge stored in the read capacitor comprises:

measuring a change in voltage across the read capacitor; and determining the change in charge stored in the read capacitor from the change in voltage across the read capacitor.

18. The method as claimed in claim 17, further comprising, prior to determining the capacitance of the electroluminescent device from the change in the charge stored in the read capacitor:

charging a parasitic capacitance of a read line coupling the read capacitor and the electroluminescent device such that substantially none of the change in the charge stored on the read capacitor corresponds to a change in a charge stored by the parasitic capacitance.

19. The method claimed in claim 18, wherein charging the parasitic capacitance comprises charging the parasitic capacitance to a voltage equal to the voltage of the read capacitor.

20. The method as claimed in claim 17, further comprising, prior to determining the capacitance of the electroluminescent device from the change in the charge stored in the read capacitor:

charging a parasitic capacitance of a read circuit in which the read capacitor is situated such that substantially none of the change in the charge stored on the read capacitor corresponds to a change in a charge stored by the parasitic capacitance.

21. The method claimed in claim 20, wherein charging the parasitic capacitance comprises charging the parasitic capacitance to a voltage equal to the voltage of the read capacitor.

* * * * *